US005911277A

United States Patent [19]

Hromas et al.

[11] Patent Number: 5,911,277

[45] Date of Patent: Jun. 15, 1999

[54] SYSTEM FOR ACTIVATING A PERFORATING DEVICE IN A WELL

[75] Inventors: Joe C. Hromas; Klaus B. Huber, both of Sugar Land, Tex.

[73] Assignee: Schlumberger Technology Corporation, Sugar Land, Tex.

[21] Appl. No.: 08/934,786

[22] Filed: Sep. 22, 1997

[51] Int. Cl.[6] ..... E21B 43/1185

[52] U.S. Cl. ..... 166/297; 166/55.1; 175/4.56

[58] Field of Search ..... 166/297, 55.1, 166/55; 175/4.53, 4.54, 4.55, 4.56, 4.59

[56] References Cited

U.S. PATENT DOCUMENTS

| | | | |
|---|---|---|---|
| 4,172,421 | 10/1979 | Regalbuto | 166/55.1 X |
| 4,496,010 | 1/1985 | Chapman, II | 175/4.55 |
| 4,574,892 | 3/1986 | Grigar et al. | 175/4.51 |
| 4,936,618 | 6/1990 | Sampa et al. . | |
| 4,971,147 | 11/1990 | Thomeer . | |
| 4,984,632 | 1/1991 | Sampa et al. . | |
| 5,020,592 | 6/1991 | Muller et al. . | |
| 5,025,861 | 6/1991 | Huber et al. | 166/297 |
| 5,044,437 | 9/1991 | Wittrisch | 166/297 X |
| 5,052,489 | 10/1991 | Carisella et al. | 166/297 |
| 5,159,146 | 10/1992 | Carisella et al. | 175/4.54 X |
| 5,293,940 | 3/1994 | Hromas et al. . | |
| 5,318,126 | 6/1994 | Edwards et al. . | |
| 5,366,013 | 11/1994 | Edwards et al. . | |
| 5,429,192 | 7/1995 | Huber et al. . | |
| 5,505,261 | 4/1996 | Huber et al. . | |
| 5,509,481 | 4/1996 | Huber et al. . | |
| 5,680,905 | 10/1997 | Green et al. | 175/4.54 |

OTHER PUBLICATIONS

"Perforating" by Bell, et al., SPE Monograph Series, 1995 (ISBN 1–5563–059–6).

*Primary Examiner*—Frank Tsay
*Attorney, Agent, or Firm*—John J. Ryberg; Gordon G. Waggett

[57] ABSTRACT

Apparatus and method for activating a device in a well, such as firing a perforating gun in a well. An electrically-activated firing system is coupled to an actuating assembly, which includes a release piston movable by fluid pressure, a firing pin, and a frangible element connected to hold the release piston in place, the frangible element being shattered in response to electrical activation of the firing system. A locking mechanism locks the firing pin to prevent movement of the firing pin, and the release piston is connected to release the locking mechanism if a minimum amount of fluid pressure is applied to the release piston after electrical activation of the firing system. A detonating assembly is connected to the perforating gun and is activable by the firing pin. The detonating assembly is activated when the firing pin is released by the locking mechanism to impact the detonating assembly.

35 Claims, 14 Drawing Sheets

SYSTEM FOR ACTIVATING A PERFORATING DEVICE IN A WELL

BACKGROUND

The invention relates to a system for activating a device in a well.

After a well has been drilled and casing has been cemented in the well, one or more portions of the casing adjacent pay zones are perforated to allow fluid from the surrounding formation to flow into the well for production to the surface. Perforating guns may be lowered on a tubing string into the well and the guns fired to create openings in the casing and to extend perforations into the surrounding formation.

Several firing techniques are available for firing perforating guns, including percussion-, pressure-, and electrically-actuated systems. Referring to FIGS. 5A–5C, in one type of system having a percussion-actuated firing head 401, a drop bar 400 (which is a cylindrical weight or sinker bar) is dropped down the tubing string from the surface or lowered downhole with a slick line. The drop bar 400 strikes a percussion-type detonator 402 in the gun firing head. As a safety feature, the drop bar contains a firing pin 404 that automatically retracts (FIG. 5C) at a set time after impact (FIG. 5B). As the firing pin 404 retracts, the drop bar 400 comes to rest on a guide stop 406 in the firing head 401 to prevent the drop bar 404 from contacting the percussion detonator 402. As a result, if the perforating guns do not fire for any reason after impact, the retracted firing pin on the drop bar 400 cannot impact the percussion detonator 402 to fire the guns when the gun string is being retrieved from the well.

Referring to FIG. 6, in a pressure-actuated firing system, differential pressure is used to fire the perforating guns. Pressure to actuate the firing head 501 is applied down the annulus between the tubing above the firing head and tubing packer (not shown) and the casing 501. The differential-pressure firing head 506 utilizes a flow tube 502 through the production tubing packer to transfer annulus pressure above the packer to an isolated release piston 503 in the firing head 506 located beneath the packer. The release piston 503 is held in place by shear pins 504. The annulus pressure above the packer is applied in region 511 against the top surface of the release piston 503. Fluid pressure from the rathole 513 (the region of the well beneath the packer) is transmitted through slots 505 into a chamber 512 under the piston 503.

When the annulus pressure exceeds the rathole pressure by a predetermined amount, the differential pressure causes the release piston 503 to break the shear pins 504 and to drive a firing pin 507 into a percussion cap 509, which then initiates a detonating cord 510 to fire the perforating gun. The safety features in such a pressure-actuated firing system include the shear pins that lock the release piston 503 until sufficient differential pressure is applied from the surface to break the shear pins and move the release piston.

In an electrically-actuated firing system, an actuating electric current is transmitted along an electrical conductor connected between the firing head and an electric power source at the surface. The electrical conductor can be run in a wireline or through a coiled tubing. FIG. 7 illustrates an example of an electrical line 34*a* run through a coiled tubing 44*a*. The coiled tubing 44*a* is connected to a coiled tubing logging head 46*a*, which in turn is connected to a deployment bar 50*a*. The firing head of the perforating system is located in the deployment bar 50*a* and includes an electrical detonator 102*a*. The electric line 34*a* runs from the surface through the coiled tubing logging head 46*a* and the deployment bar 50*a* to the detonator 102*a*. Electric current in the electric line 34*a* activates the electrical detonator 102*a* in the firing head to initiate a detonating cord 104*a* that extends to the perforating gun 52*a*. In the electrically-actuated system depicted in FIG. 7, electrical connection and ballistic connection (between the detonator 102*a* and the detonating cord 104*a*) have both been made before the perforating tool is lowered downhole. As long as safety procedures are strictly followed to ensure that the surface electric source is not activated while the gun string is being lowered, inadvertent firing of the gun may be avoided.

SUMMARY

In general, in one aspect, the invention features an apparatus for firing a perforating gun in a well that includes an electrically-activated firing module. An actuating assembly is coupled to the firing module, and the actuating assembly includes a release piston movable by fluid pressure and a locking assembly connected to hold the release piston in position. The locking assembly is responsive to electrical activation of the firing module to release the release piston. A detonating assembly is connected to the perforating gun, and the detonating assembly is activated in response to movement by the release piston.

Implementations of the invention may include one or more of the following features. The locking assembly includes a frangible element connected to hold the piston assembly in place, the frangible being shattered in response to electrical activation of the firing module. The firing module includes an electrical detonator connected to a detonating cord. The detonating cord is extended to be adjacent to the frangible element, and activation of the electrical detonator initiates a detonation wave in the detonating cord. The detonation wave shatters the frangible element. The actuating assembly includes a chamber filled with well fluid under pressure of the well and a chamber filled with air. The release piston is moved by differential pressure between the well fluid chamber and air chamber. The detonating assembly includes a percussion detonator, and the actuating assembly includes a firing pin and a firing pin locking mechanism for locking the firing pin to prevent the firing pin from impacting the detonator. The release piston is adapted, in its movement, to release the firing pin locking mechanism. The actuating assembly further includes shear pins for holding the release piston. The fluid pressure must apply a force of sufficient magnitude to break the shear pins to move the release piston. A firing pin is driven by pressure generated by fluid in a fluid chamber housing, the fluid chamber housing being initially filled with air. The actuating assembly includes an explosive detonated in response to electrical activation of the firing module to create an opening in the fluid chamber housing to allow well fluid under pressure to flow into the fluid chamber housing. The fluid chamber housing is defined at least in part by a hollow tube connected at one end to be moved by the release piston, and constructed at the other end to release the firing pin. Seats are disposed about the hollow tube and sealably engaged between the hollow tube and an outer housing to cooperate in defining the fluid chamber with air in the vicinity of the firing pin. A connecting assembly is configured for connection between the electrically-activated firing module and a coiled tubing. A connecting assembly is configured for connection between the electrically-activated firing module and a wireline. The detonating assembly includes a detonator coupled to a detonating cord. The detonating cord is connected to the perforating gun.

In general, in another aspect, the invention features an apparatus for firing an electrically-activated perforation system having a perforating gun in a well using an electric power source. An electrically-activated firing module is electrically connected to the electric power source. A detonating assembly is connected to the perforating gun. An actuating system is connected to the firing module for ballistically connecting the firing module to the detonating assembly once a minimum amount of fluid pressure is applied to the actuating system.

In general, in another aspect, the invention features a method of firing a perforating gun in a well. A perforating apparatus is connected to the perforating gun, the perforating apparatus including an electrically-activated firing module, an actuating assembly coupled to the firing module, and a detonating assembly. The actuating assembly includes a release piston movable by fluid pressure and a locking assembly connected to hold the release piston in position. The firing apparatus and perforating gun are lowered into the well. The firing module is electrically activated. The locking assembly is configured to respond to the electrical activation by releasing the release piston, and the detonating assembly is activated to fire the perforating gun in response to movement of the release piston.

In general, in another aspect, the invention features a method of firing an electrically-activated perforation system having a perforating gun in a well using an electric power source. An electrically-activated firing module is electrically connected to the electric power source. The perforation system is lowered downhole in the well. The firing module is ballistically connected to a detonating cord once a minimum amount of fluid pressure is present.

In general, in another aspect, the invention features an apparatus for firing a perforating gun in a well. An electrically-activated firing system is coupled to the firing system. The actuating assembly includes a release piston movable by fluid pressure, and a frangible element connected to hold the release piston in place, the frangible element being shattered in response to electrical activation of the firing system. The actuating assembly further includes a firing pin and a locking mechanism for locking the firing pin to prevent movement of the firing pin. The release piston is connected to release the locking mechanism if a minimum amount of fluid pressure is applied to the release piston after electrical activation of the firing system. A detonating assembly is connected to the perforating gun and is activable by the firing pin. The detonating assembly is activated when the firing pin is released by the locking mechanism to impact the detonating assembly.

In general, in another aspect, the invention features a detonating apparatus for activating an electrically-activated device in a well using an electric power source. An electrically-activated activation module is electrically connected to the electric power source. A detonating assembly is connected to the device. An actuating system is connected to the activation module for ballistically connecting the activation module to the detonating assembly once a minimum amount of fluid pressure is applied to the actuating system.

In general, in another aspect, the invention features a method of electrically activating a device in a well using an electric power source. An electrically-activation module is electrically connected to the electric source. The device is lowered downhole in the well. The activation module is ballistically connected to a detonating cord once a minimum amount of fluid pressure is present.

Implementations of the invention may include one or more of the following advantages. Accidental firing of perforating guns in an electrically-actuated perforation system is avoided while the gun string is on the surface before it is lowered downhole, even if safety procedures for an electrically-activated system have not been followed. The perforation system is electrically connected before it is ballistically connected; thus, accidental electrical activation of the perforation system does not fire the gun string since the required ballistic connection has not been made.

DESCRIPTION

Figure 1:
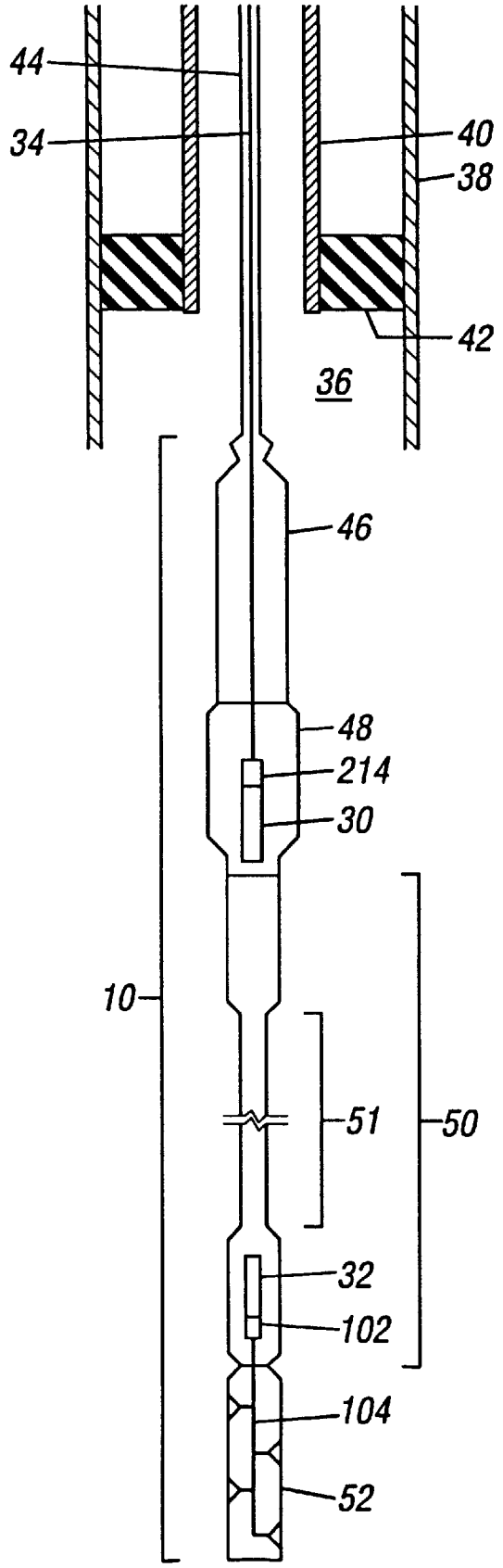
FIG. 1 is a diagram of a coiled tubing electrically-actuated perforation system positioned downhole in a well.

Referring to FIG. 1, an electrically-actuated perforation system 10 suspended by a coiled tubing string 44 is positioned downhole in the bore 36 of a cased well string 38. An electric conductor 34 extends through the coiled tubing 44 to the perforation system 10, which is actuated in part by the transmission of an electric current down the electric conductor 34. Other events are needed to ensure the safe firing of perforating guns in the perforation system 10, effective to prevent firing particularly when the perforation system 10 is located at the surface or initially is being lowered into the well.

The perforation system 10 includes a perforating gun string 52 attached below a deployment bar 50. The deployment bar 50 includes a narrowed section, or turndown section, 51 to match the diameter of the coiled tubing 44 And the configuration of a blowout preventer (not shown).

As described in further detail below, the deployment bar 50 contains a percussion detonator 102 connected to a detonating cord 104 that is connected to shaped charges in the perforating gun string 52. The percussion detonator 102 is attached to a firing pin assembly 32 that contains a firing pin 124 and a locking mechanism (shown in FIG. 2E). The locking mechanism prevents movement of the firing pin until the occurrence of a chain of events initiated by transmission of an electrical current down the electrical conductor 34 in the tubing. Once the locking mechanism is released in the firing pin assembly 32, hydrostatic pressure drives the firing pin into the percussion detonator 102 to ignite the detonating cord 104.

The deployment bar 50 at its top end is connected to a firing module 48, which contains an electric detonator 214 (such as a 50-ohm resistor type detonator) coupled to a safety mechanism 30. The electric detonator 214 is activated by an electric current transmitted from the surface through the electric conductor 34. The safety mechanism 30 of the firing module 48 in cooperation with the locking mechanism of the deployment module 50 implement safety features to prevent accidental firing of the perforating guns while they are on the surface or initially being lowered into the well.

Figure 2A:
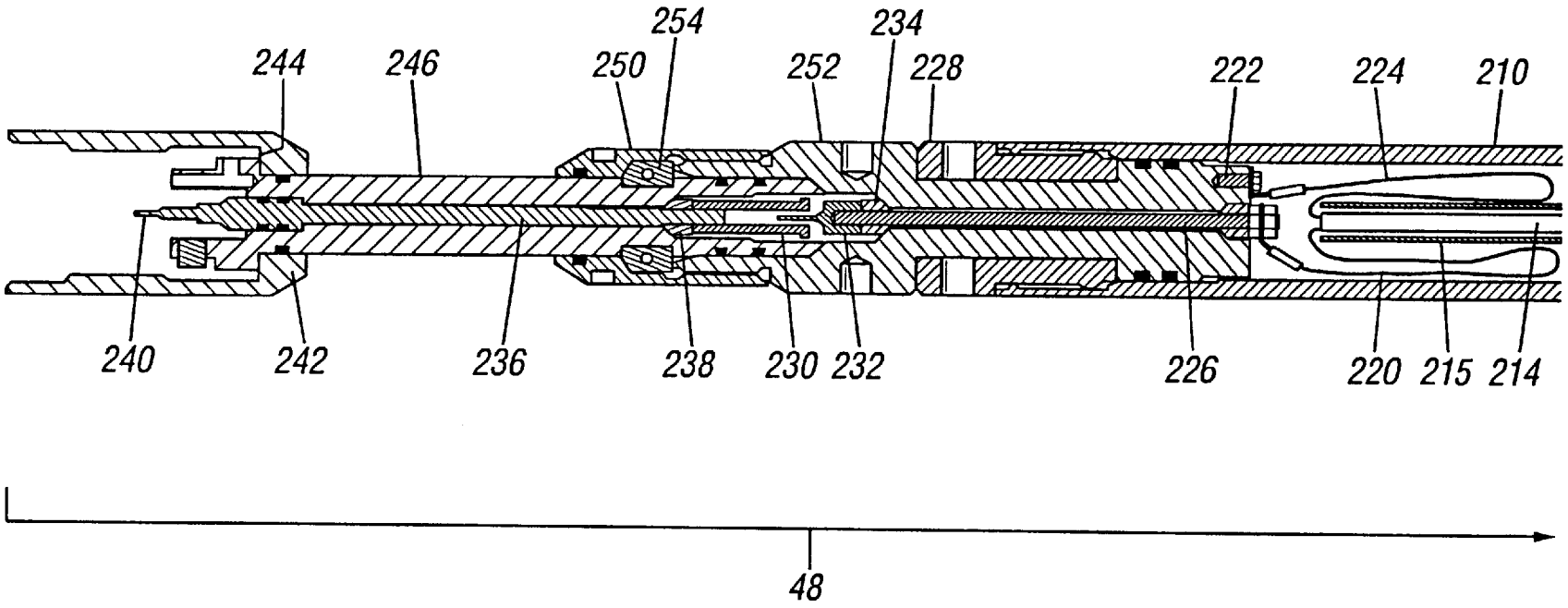
FIGS. 2A–2E are diagrams of the sections of a firing module and a deployment bar in the perforation system.
Figure 2B:
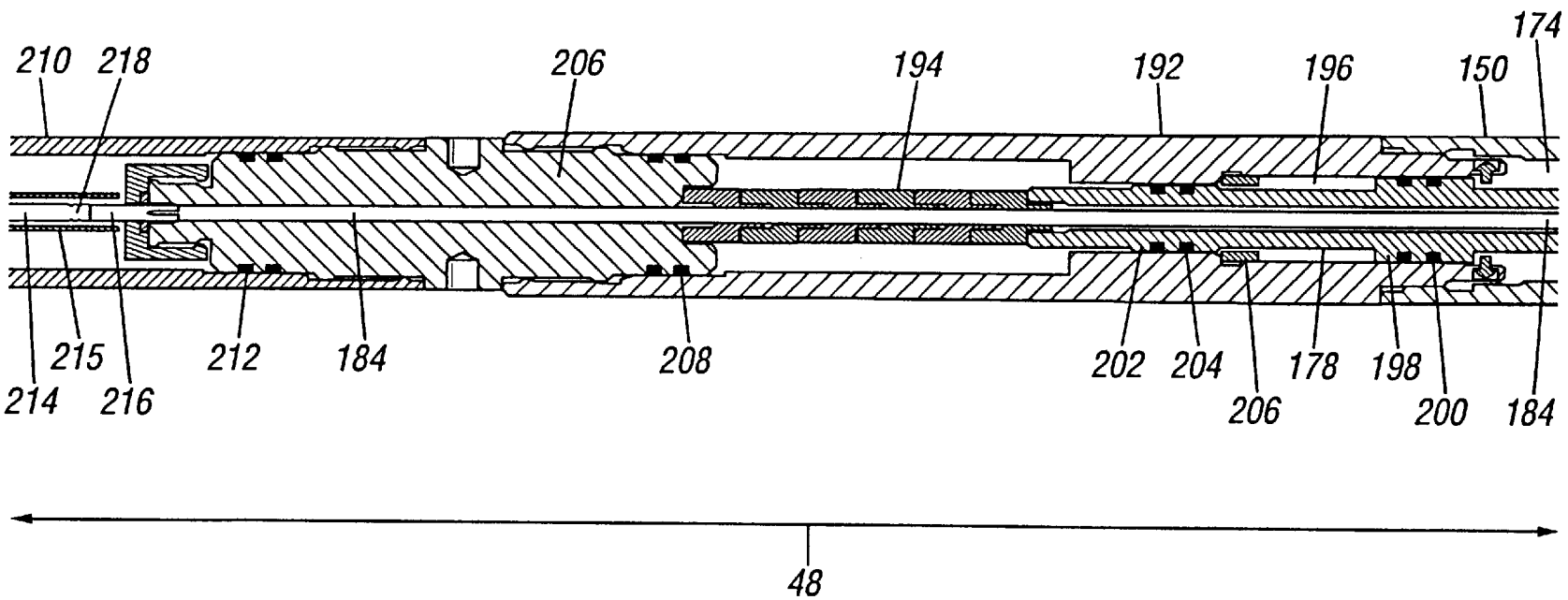
Figure 2C:
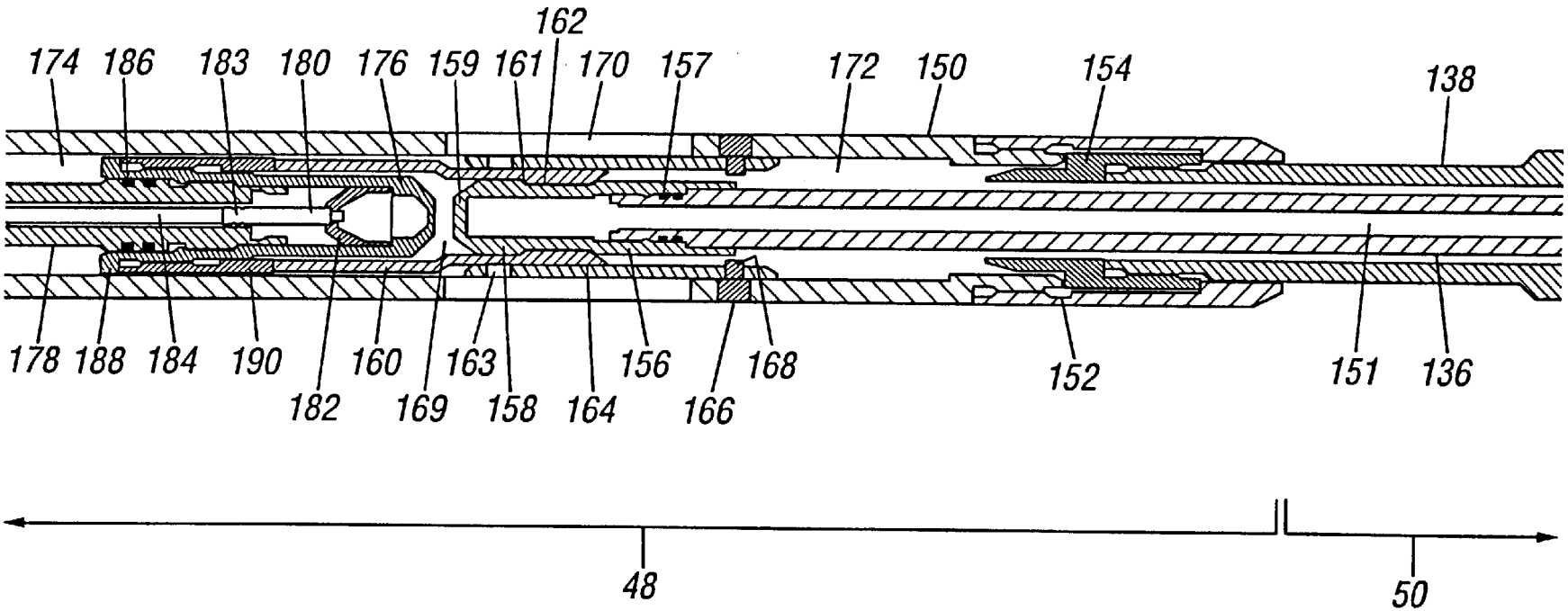

The safety mechanism 30 includes a pressure-actuated release piston 178 (FIGS. 2B–2C), a frangible element 194 (FIG. 2B) to fix the release piston in position, and a shaped charge 182 (FIG. 2C). Two factors must be present before the release piston can move: the frangible element must be shattered; and at least a minimum amount of differential pressure must be applied to the release piston. Movement of the release piston by a predetermined distance releases the locking mechanism in the firing pin assembly 32. The frangible element is shattered and the shaped charge is fired to initiate movement of the release piston by a detonation wave initiated in a detonating cord in the safety mechanism 30 by activation of the detonator 214. Firing the shaped charge in the firing module 48 creates an opening to generate fluid flow to the firing pin assembly 32 to apply hydrostatic pressure to drive the firing pin downward.

Thus, to fire the perforating guns 52, several events have to occur. First, an electric current is transmitted down the electric conductor 34 to activate the electric detonator 214 and initiate a detonating wave in the detonating cord in the safety mechanism 30, which shatters the frangible element and fires the shaped charge. The release piston is then freed to move if sufficient differential pressure is applied to the release piston. Movement of the release piston by a predetermined distance releases the locking mechanism. Hydrostatic pressure then drives the firing pin in the deployment bar 50 into the percussion detonator 102 to fire the gun string 52.

The perforation system 10 is unable to fire while it is on the surface or initially being lowered downhole because of the lack of sufficient differential pressure (created by the hydrostatic pressure of the fluid in the well) to actuate the release piston in the safety mechanism 30. Thus, even if the perforation system 10 is electrically activated accidentally (thereby shattering the frangible element and firing the shaped charge), the safety mechanism 30 prevents firing of the perforating guns when the mechanism is not exposed to sufficient downhole pressure. The housing of the firing module 48 can withstand and contain the detonation of the shaped charge in the safety mechanism 30, which further reduces the risk of injury at the wellsite.

Although the detonating cord 104 running through the gun string 52 is connected to the percussion detonator 102 in the deployment bar 50, no effective ballistic connection exists in the firing module/deployment bar assembly until and unless a sufficient pressure is applied in the vicinity of safety mechanism 30 to apply the required differential pressure to actuate the release piston in the safety mechanism 30. The ballistic connection is not present in the absence of such pressure because, if the release piston has not been moved as a result of such pressure, the locking mechanism in the firing pin assembly 32 cannot be released to drive the firing pin into the percussion detonator 102. Thus, in the electrically-actuated perforation system 10, one important safety feature is that the perforation system 10 may be electrically connected before it is ballistically connected. The ballistic connection does not occur until the perforation system 10 has been lowered to a depth at which sufficient pressure in the well is present to enable actuation of the release piston.

Referring to FIGS. 2A–2E, the deployment bar 50 is made up of three housing sections, all made of alloy steel: a bottom housing section 100, a middle housing section 112, and a top housing section 138. The housing sections of the deployment bar 50 are threadably connected to one another. The firing module 48 also includes three housing sections made of alloy steel: a bottom housing section 150 connected to the top housing section 138 of the deployment bar 50; a middle housing section 192; and a top housing section 210. The bottom housing section 150 is threadably connected to the middle housing section 192, which is connected to the top housing section 210 through a connector piece 206 (FIG. 2B).

Figure 2D:
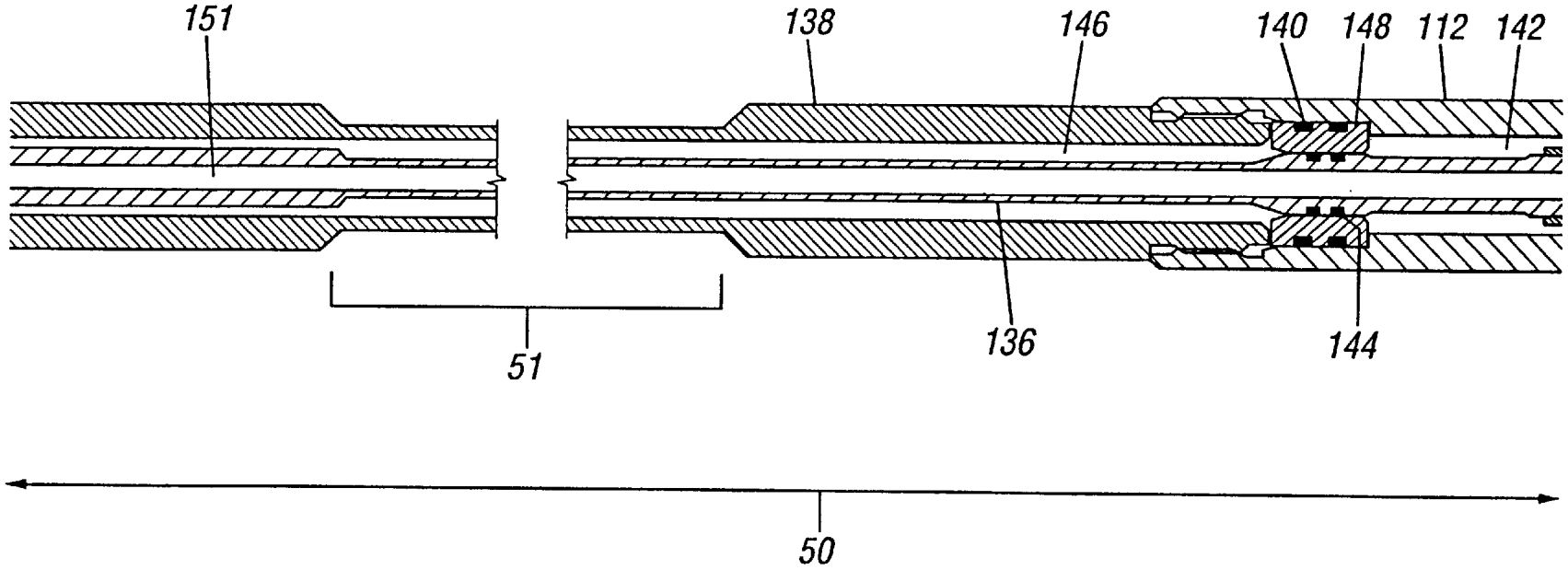
Figure 2E:
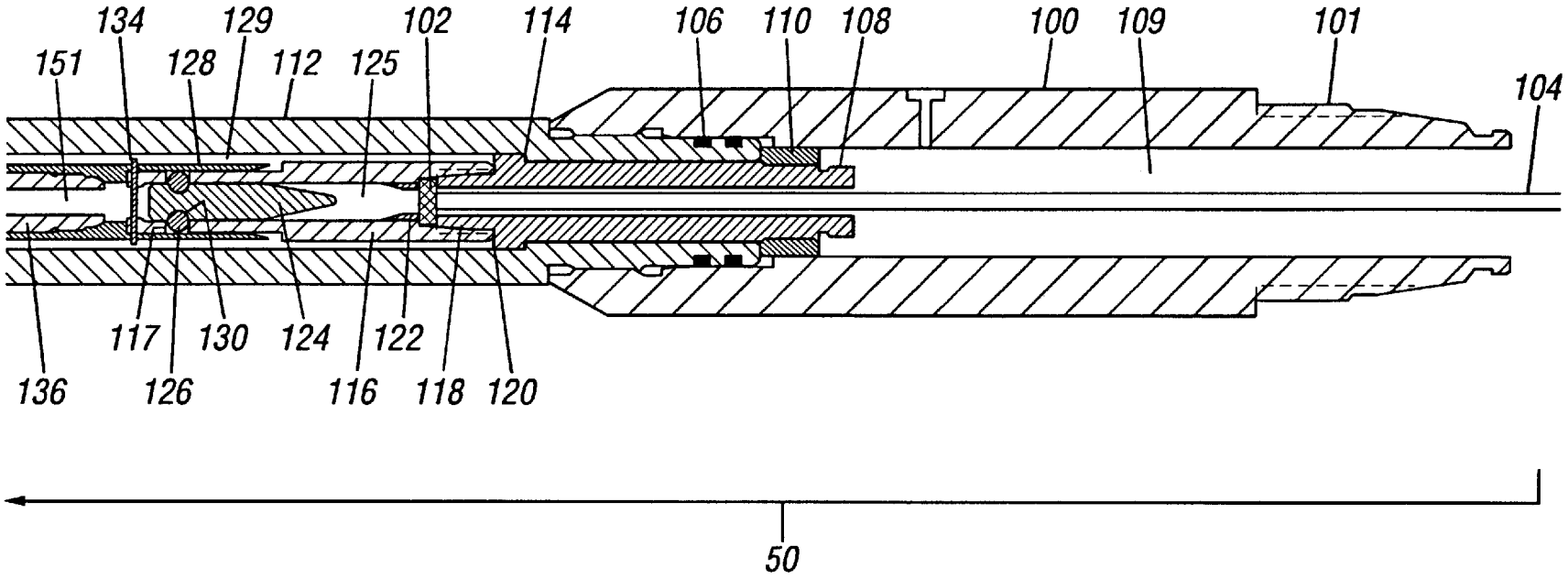

As shown in FIG. 2E, the bottom housing section 100 of the deployment bar 50 has at its lower end outer threads 101 for connecting the deployment bar 50 to the string of perforating guns 52. The detonating cord 104 (such as a Primacord) is attached to the percussion detonator 102 located in the housing section 100 and extends through the perforating gun string 52. The upper portion of the detonating cord 104 runs through a metal tubular member 108 having a flange near its top end that rests on a shoulder 114 of the middle housing section 112 of the deployment bar 50.

The internal tubular member 108 is further threaded to a holding ring 110 at its lower end, with the holding ring 110 contacting the bottom surface of the middle housing section 112 to hold the internal tubular member 108 in position inside the deployment bar 50. The middle housing section 112 is threadably connected to the bottom housing section 100, with O-ring seals 106 providing a sealed connection between the bottom housing section 100 and the middle housing section 112.

The tubular member 108 includes a neck portion 118 that is threadably connected to the bottom of a firing pin housing 116. The percussion detonator 102 is located between the upper end of the neck portion 118 of the tubular member 108 and a seat 122 inside the firing pin housing 116.

The percussion detonator 102 is activated by the firing pin assembly 32 (FIG. 1), which includes a firing pin 124 (FIG. 1E) and a locking mechanism formed in part by ball bearings 126, a release sleeve 128, breakable shear pins 134, and a movable tubular member 136. The firing pin 124 is driven by differential pressure to impact the detonator 102. To lock the firing pin 124 against axial movement, it has a circumferential slot 130 for receiving the ball bearings 126. The firing pin housing 116 includes openings 117 for receiving the ball bearings 126, which are held in the slot 130 of the firing pin 124 and the openings 117 of the firing pin housing 116 by the release sleeve 128. The upper part of release sleeve 128 is attached by a threaded connection to the tubular member 136.

The breakable shear pins 134 are fitted through radial openings in the wall of the release sleeve 128 and in the upper end of the firing pin housing 116 to hold the release sleeve 128 in position. A differential pressure of at least about 300 psi must be applied across the release piston 178 (FIGS. 2B–2C) to lift the assembly and break the shear pins 134. However, other values can be set using different shear pins. The upper portion of the release sleeve 128 is threadably connected to the movable tubular member 136. When firing the perforating gun string 52, the locking mechanism of the firing pin assembly 32 is released by lifting the movable tubular member 136 to break the shear pins 134 and to move the release sleeve 128 so that the ball bearings 132 can move radially outward from the slot 130 of the firing pin 124 into the space 129 inside the middle housing section 112.

The interior space 151 of the movable tubular member 136 (initially filled with air at atmospheric pressure) will fill rapidly with well fluid at well pressure after the safety mechanism 30 is activated, to drive the firing pin 124 into the percussion detonator 102 to initiate a detonation wave in the detonating cord 104. Differential pressure to actuate the firing pin 124 is created by the difference in pressure between the interior space 151 of the tubular member 136 and a chamber 125 underneath the firing pin 124 (which is filled with air).

As shown in FIG. 2D, the middle housing section 112 of the deployment bar 50 is threadably connected to the top housing section 138 of the deployment bar 50. O-ring seals 140 and 144 provide seals to prevent fluid from flowing from the space 146 inside the upper housing section 138 into the space 142 inside the middle housing section 112 when the tubular member and the attached release sleeve 128 are in their lower position, thereby preventing fluid flow to the firing pin 124. The O-ring seals 140 are held in place by a retainer ring 148, and the O-ring seals 144 are held in slots in the outer surface of the tubular member 136. The entire movable tubular member 136 can be moved upward by the release piston 178 (FIG. 2C) in the safety mechanism 30 of the firing module 48. When the tubular member 136 is lifted, fluid is allowed to flow into the space 142.

As shown in FIG. 2C, the top housing section 138 of the deployment bar 50 is attached to the bottom housing section 150 of the firing module 48 by a nut 152. A guide 154, which is attached to the upper end of housing section 138 by a threaded connection, is used to align the firing module bottom housing section 150 properly with respect to the deployment bar top housing section 138 when the nut 152 is tightened onto the lower end of housing section 150.

The safety mechanism 30 (FIG. 1) of the firing module 48 includes a shaped charge 182 (FIG. 2C), a first cap 158 threadedly connected to the movable tubular member 136 of the deployment bar 50, a second cap 176 for holding the shaped charge, the release piston 178, and a frangible element 194 (FIG. 2B).

The first cap 158 is screwed onto the tubular member 136. O-ring seals 157 prevent fluid flow into the interior space 151 of the movable tubular member 136. Fluid from the well bore 36 flows through axial slots 170 in the firing module bottom housing section 150 to fill at well pressure the regions 169, 172 and 174 inside the housing section 150. The flow to regions 169 and 172 is via ports 163 in sleeve 164 described below.

Collet fingers 160 are fitted over the cap 158. The upper ends of the collet fingers 160 are integrally attached to a tube 190. The collet fingers 160 are expandable to fit over the first cap 158. Once the collet fingers 160 are fitted over the cap 158, a holding sleeve 164 is pushed over the fingers inside the firing module bottom housing section 150 to tightly fit the collet fingers 160 over the cap 158. Internally threaded portions of the collet fingers 160 are mated with externally matching threads 161 on the first cap 158 to allow the collet fingers 160 to lift the first cap 158. Once the holding sleeve 164 is properly positioned, a radial screw 166 is inserted into a threaded hole 168 in the holding sleeve 164 to fix the holding sleeve 164 in place.

The second cap 176 holds the shaped charge 182 above the first cap 158. The shaped charge 182 is abutted by an empty shell 180, which is in turn connected to a detonating cord 184 by crimping the outer shell (which can be made of aluminum) of the shell 180 around the detonating cord 184 at 183. The second cap 176 is screwed onto the release piston 178, with seals 186 sealing off the explosive from well fluids in the space 174. The upper portion of the second cap 176 includes a shoulder 188 and outer threads to connect to the top tube 190 integrally attached to the collet fingers 160.

If the release piston 178 is moved up, it will lift the assembly made up of the second cap 176, the collet fingers 160, the first cap 158, and the movable tubular member 136 along with it. The movement brings space 146, at well fluid pressure, into communication with space 142.

As shown in FIG. 2B, the bottom housing section 150 of the firing module 48 is threadably connected to the middle housing section 192. The release piston 178 includes a first protruding portion 198 having circumferential grooves in its outer surface to receive O-ring seals 200. The outer surface of the first protruding portion 198 is pressed against the inner wall of the top housing section 192 of the firing module to isolate an air chamber 196 from the region 174 (which is filled with well fluid). The air chamber 196 is isolated on its other end with O-ring seals 204 located in grooves in a second protruding portion 202 of the piston. The differential pressure created by the pressure applied by the well fluid in the region 174 and the air pressure in the chamber 196 generates a force to push the release piston 178 in an upward direction in the firing module 48.

The force produced by the applied differential pressure must be sufficient to lift the weight of the release piston 178 along with the assembly made up of the second cap 176, the collet fingers 160, the first cap 158, and the movable tubular member 136. In addition, the applied differential force must be sufficient to break the shear pins 134 in the firing pin assembly 32 of the deployment bar 50. In the design show, the minimum differential pressure which must be generated then to move the release piston 178 is about 300 psi.

To prevent movement of the release piston 178 until firing is desired, the frangible element (formed of multiple rigid break plugs) 194 is positioned above the release piston 178. Each of the break plugs 194 can be made of a cast iron material, such as white iron, gray iron, ductile iron, or malleable iron. The detonating cord 184 runs through the release piston 178, the frangible element 194, and a connector piece 206 threadably connected to the top housing section 210. Once initiated, a detonating wave is transmitted through the detonating cord 184 to shatter the break plugs 194, which fall into the region 194 (filled with air) to allow the release piston 178 to be pushed up by the applied differential pressure.

The connector piece 206 connects the firing module middle housing section 150 to the top housing section 210, the connections being sealed with O-rings 208 and 212. At its upper end, the detonating cord 184 is connected to an electric detonator 214 (such as a 50-ohm resistor type detonator) by crimping the outer shell (which can be made of aluminum) of the detonator 214 around the detonating cord 184.

As shown in FIG. 2A, the electric detonator 214, wrapped in a plastic sleeve 215, is connected to electrical wires 220 and 224. The electrical wire 224 is attached to a ground connection 222 at the metal housing of an electric line adaptor 252. The wire 220 is connected to one end of an electrically conductive rod 226, which passes through the electric line adaptor 252, the latter connected to the upper end of the firing module top housing section 210 by a nut 228. The rod 226 is electrically connected at its upper end to a conductive pin 232. The rod 226 is encased in an electrically-insulating layer to isolate it from the electric line adaptor 252. An insulating sleeve 234 prevents electrical contact between the pin 232 and the electric line adaptor 252.

The pin 232 fits in and makes electrical contact with an electrical receptacle 230, which is further contacted to one end of an insulated feed-through connector 236 located inside a feed-through housing section 246. The other end of the feed-through connector 236 has a contact 240 for electrical connection with an electrical conductor at the bottom of the coiled tubing logging head 46 (FIG. 1). A nut 242 that fits under a flange 244 extending from the feed-through housing section 246 connects the feed-through housing section 246 to the bottom end of the coiled tubing logging head 46.

A nut 250, which includes a split nut 254, fits over the electric line adaptor 252. The split nut 254 allows the nut 250 to freely swivel to screw onto the electric line adaptor 252, which allows the firing module 48 to be threadably connected to the coiled tubing logging head 46 without having to swivel either the firing module 48 or the coiled tubing logging head 46, both of which are rather heavy.

In sum, to fire the perforating guns, a chain of events must occur. First, the assembly must be subject to hydrostatic pressure, produced by immersion in well fluid. Next, an electric current must be transmitted down the electric conductor 34 in the coiled tubing 44 to activate the electric detonator 214 and initiate a detonating wave in the detonating cord 184. Only with these conditions both present will the frangible element 194, when shattered (by the detonating wave) allow the force applied by the differential pressure (created by the difference in pressure of downhole well fluid and the air chamber 196) to move the release piston 178 upward. The shaped charge 176 is also fired to blow a hole in the first cap 158 to allow well fluid to flow into the interior space 151 of the tubular member 136 to create hydrostatic pressure force against the firing pin 124.

As a first safety feature in the firing module 48, the differential pressure applied downhole by the well fluid must be sufficient to lift the release piston 178 and the assembly made up of the second cap 176, the collet fingers 160, the first cap 158, and the tubular member 136, and to break the shear pins 134 holding the release sleeve 128 in place. Without the required differential pressure, no effective ballistic connection is made in the firing module/deployment bar assembly.

A further safety mechanism in the firing module 48 is that the first cap 158 (FIG. 2C) blocks well fluid flow into the interior space 151 of the movable tubular member 136. Without the well fluid in the interior space 151, there is insufficient hydrostatic pressure to drive the firing pin 124 (FIG. 2E) with enough force to activate the percussion detonator 102 and ignite the detonating cord 104.

The firing module 48 in cooperation with the deployment bar 50 thus provides an important safety feature to prevent accidental firing of the perforating guns on the surface while the perforating gun string is being armed and attached. Even though the firing module 48 is electrically connected before the tool assembly is lowered downhole, no ballistic connection is made in the firing module/deployment bar assembly while the tool assembly remains on the surface at the wellsite, which prevents the accidental firing of the perforating guns.

As with other ballistic systems, the reduced section 51 of the deployment bar 50 enables lowering of the guns into the well and sealing of the blow out prevention on section 51 before attaching the firing module 48 to the down string.

Figure 3:
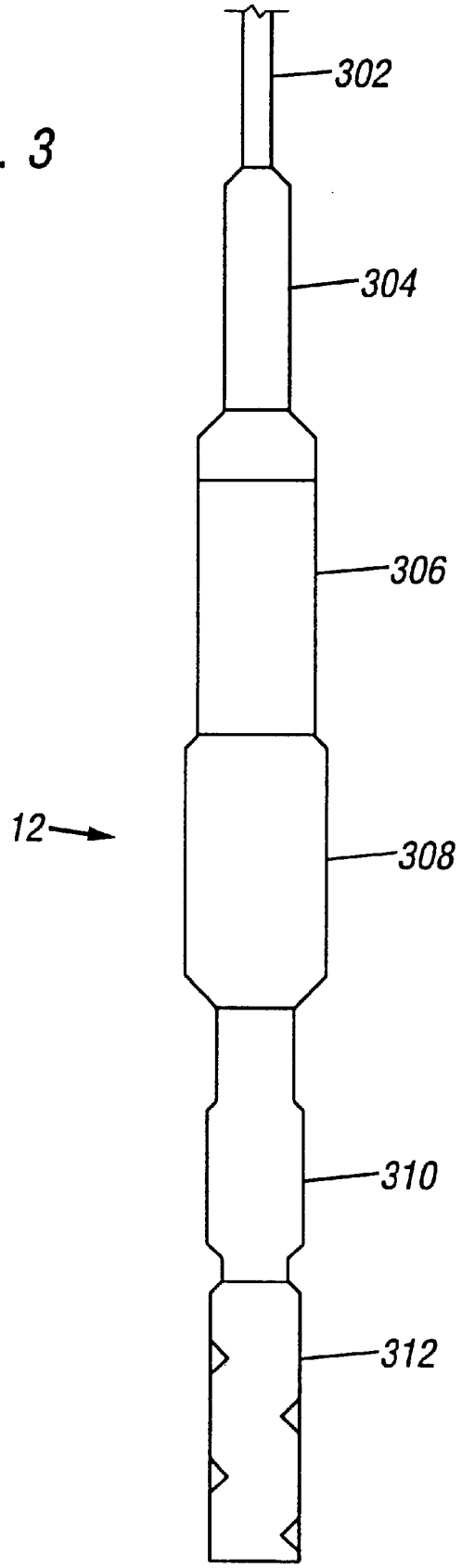
FIG. 3 is a diagram of a wireline electrically-actuated perforation system.
Figure 4A:
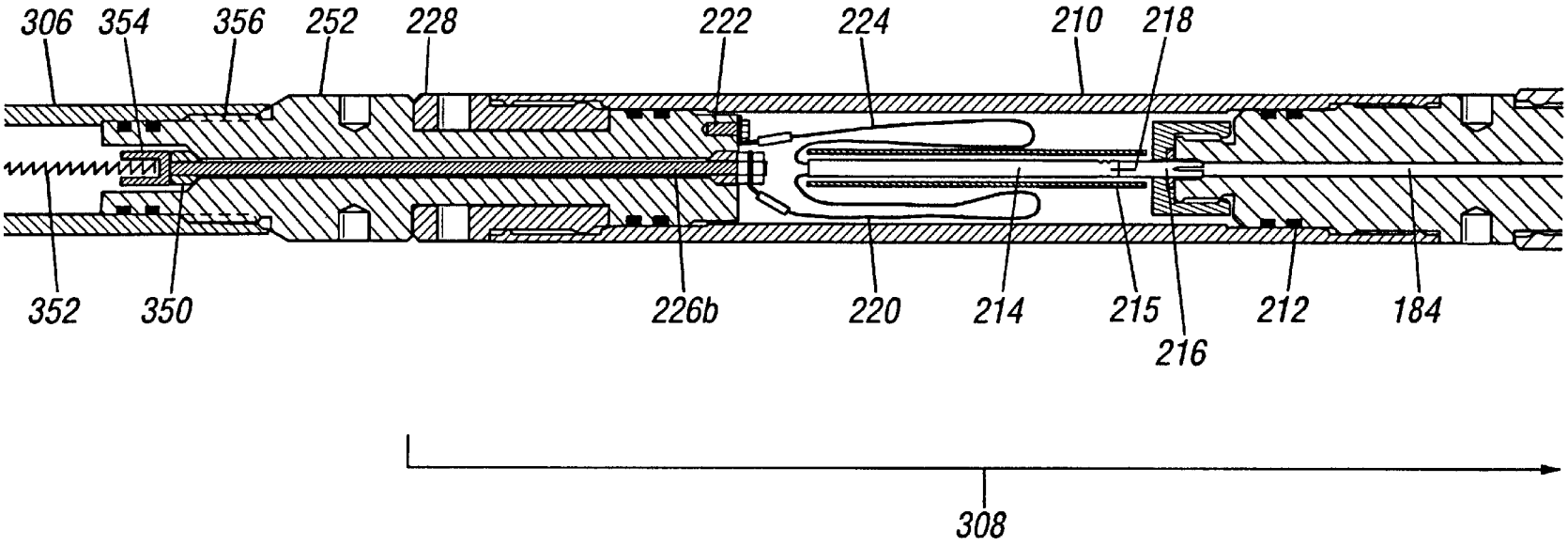
FIGS. 4A–4D are diagrams of the sections of a firing module and detonation module in the wireline perforation system.
Figure 4B:
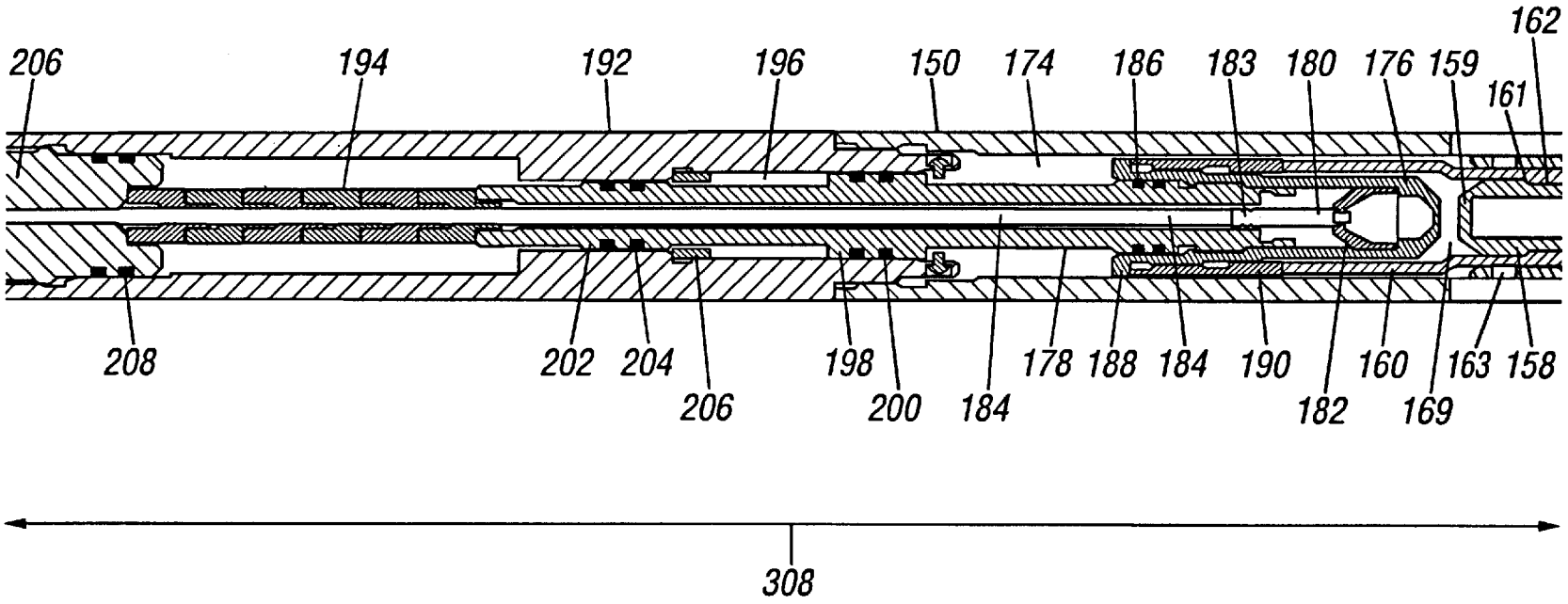
Figure 4C:
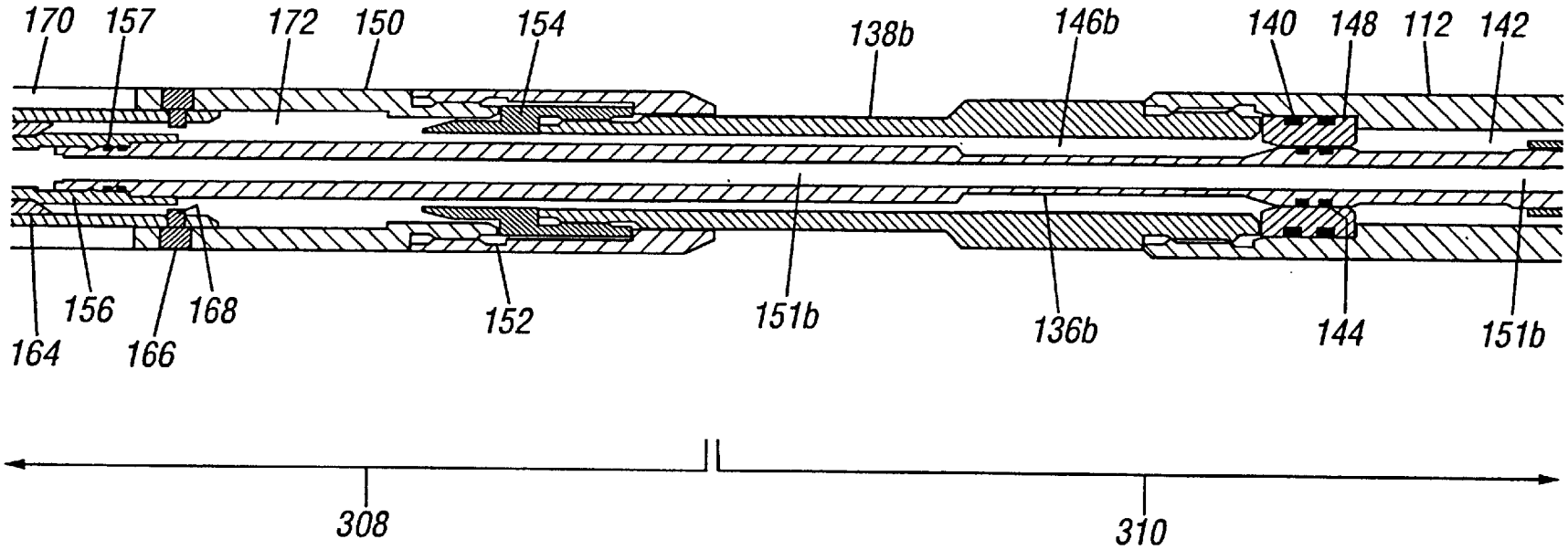
Figure 4D:
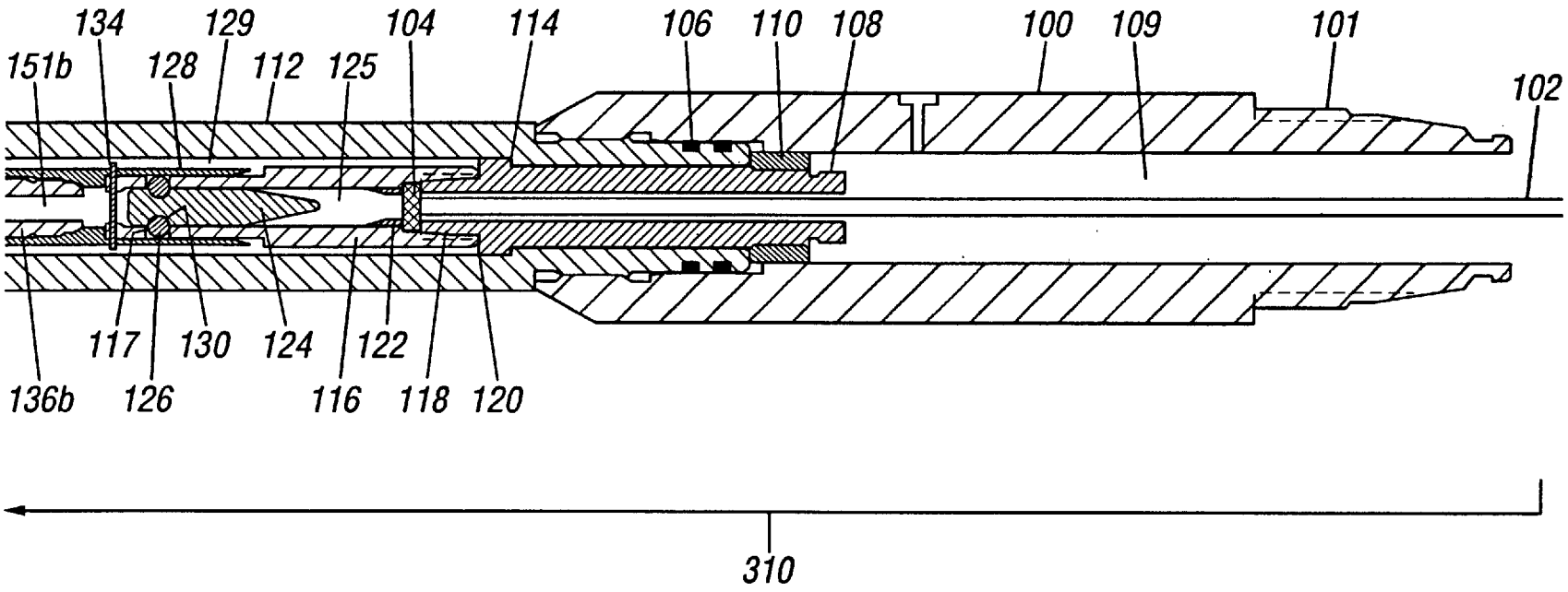
Figure 5C:
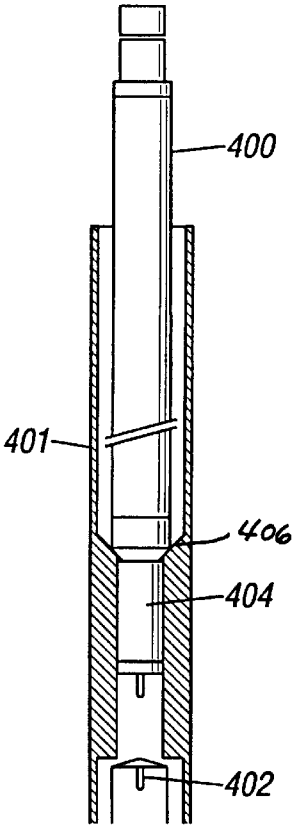
FIG. 5C (Prior Art)
FIGS. 5A–5C is a diagram of a percussion-actuated firing head.
Figure 5B:
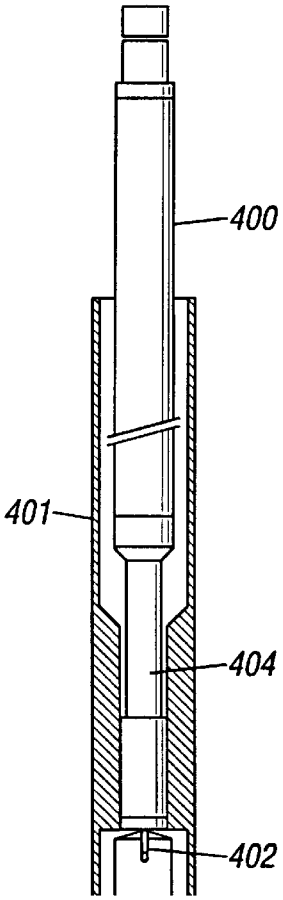
FIG. 5B (Prior Art)
Figure 5A:
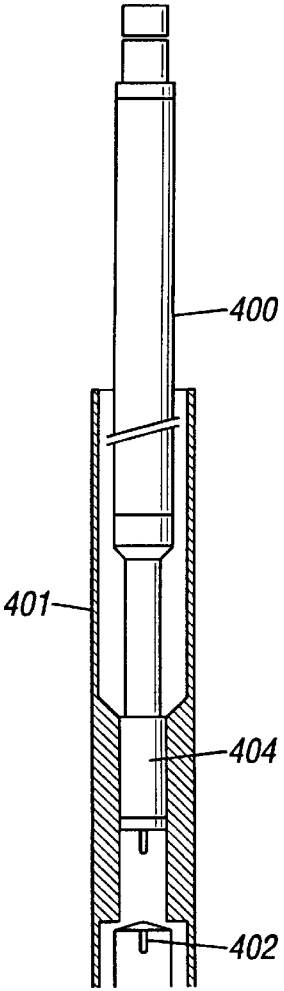
FIG. 5A (Prior Art)
Figure 6:
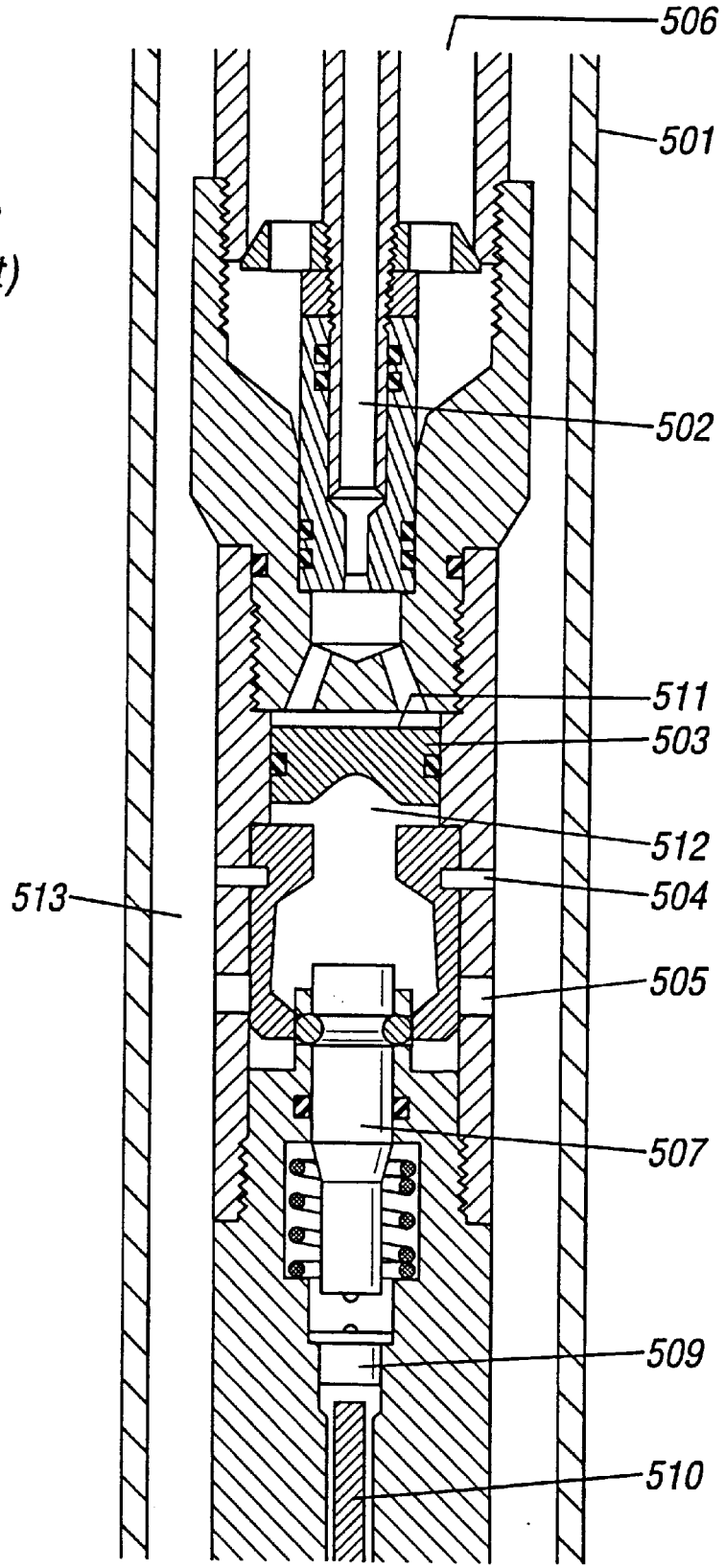
FIG. 6 (Prior Art)
FIG. 6 is a diagram of a pressure-actuated firing head.
Figure 7:
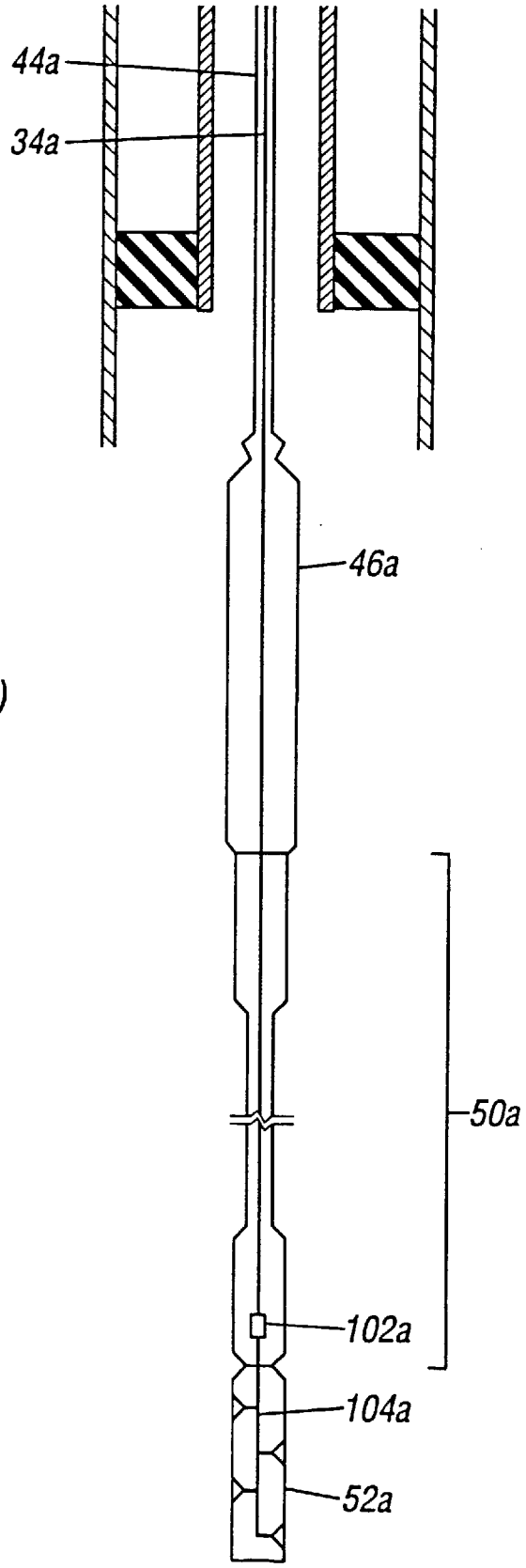
FIG. 7 (Prior Art)
FIG. 7 is a diagram of an electrically-actuated firing system.

Referring to FIG. 3, the safe firing system described can also be used with a wireline perforation system 12, which includes a wireline 302 having an electrical cable connected to a cable head 304 for connection to tools. One such tool is a casing collar locator (CCL) 306, which is used to identify the depth of a tool string. The CCL 306 is electrically connected to the wireline 302 to enable communication with surface equipment.

In the perforation system 12, the CCL 306 is further connected to a firing module 308 that is similar to the firing module 48 in the coiled tubing perforation system 10. The firing module 308 is connected to a detonation module 310, which is in turn connected to a gun string 312. The firing module 308 is electrically connected through the CCL 306 and the cable head 304 to the wireline 302.

The safety features incorporated in the coiled tubing perforation system 10 also exist in the wireline perforation system 12. The firing module 308 is identical to the firing module 48, except the firing module 308 is adapted for connection to the CCL 306 rather than to the coiled tubing logging head 46. Further, the wireline perforation system 12 does not include a deployment bar; instead, the detonation module 310 replaces the deployment bar 50. The components in the detonation module 310 are the same as those for the deployment bar 50, with certain components in the detonation module 210 shortened.

Referring to FIGS. 4A–4D, all components of the detonation module 310 and the firing module 308 that exist in the deployment bar 50 and the firing module 48, respectively, are shown with the same reference numerals. The modified components are described below.

The detonation module 310 includes three housing sections: the bottom housing section 100, the middle housing section 112, and a top housing section 138B. The firing module 308 also includes three housing sections: the bottom housing section 150, the middle housing section 192, and the top housing section 210.

The top housing section 138B of the detonation module 310 is connected to the bottom housing section 150 of the firing module 308 in similar fashion as the connection between the deployment bar 50 and the firing module 48. The firing pin assembly of the detonation module 310 is the same, except a movable tubular member 136B is much shorter than the movable tubular member 136 of the deployment bar 50.

The tubular member 136B is connected at its top end to the first cap 158, which prevents well fluid from flowing to the interior space 151B of the tubular member 136B. To fire, the shaped charge 182 opens a hole in the top of the cap 158 to allow fluid flow into the interior space 151B to create a hydrostatic pressure against the firing pin 124.

The tubular member 136B is lifted by the release piston 178 (FIG. 4B) in the firing module 308 after the frangible element 194 has been shattered by initiation of the detonating cord 184. The detonating cord 184 is initiated by the detonator 214, which is activated by an electrical current transmitted down the wireline 302 and received by an externally insulated electrically conductive rod 226B. At one end, the connecting rod 226B is connected to the detonator 214 by the wire 220. At its other end, the connecting rod is connected to a spring contact 352 in the CCL 306. The spring contact is housed in a spring contact socket 354, and the spring contact 352 makes electrical contact with the connecting rod 226B when the CCL 306 is threaded at 356 onto the electric line adaptor 252.

Other embodiments are within the scope of the following claims. For example, the percussion detonator in the deployment bar can be substituted with an electric detonator, with the electric detonator activated when an electric contact is created by movement of the release piston and movable tubular member. The safety features to prevent accidental activation can be applied to ballistically-activated tool strings other than perforation gun strings. For example, one such tool is an explosive cutter used to cut pipes downhole.

What is claimed is:

1. Apparatus for firing a perforating gun in a well, comprising:

an electrically-activated firing module;

an actuating assembly coupled to the firing module, the actuating assembly including a release piston movable by fluid pressure and a locking assembly connected to hold the release piston in position, the locking assembly responsive to electrical activation of the firing module to release the release piston; and a detonating assembly for connection to the perforating gun, the detonating assembly activated in response to movement by the release piston.

2. The apparatus of claim 1, wherein the locking assembly includes a frangible element connected to hold the piston assembly in place, the frangible element being shattered in response to electrical activation of the firing module.

3. The apparatus of claim 2, wherein the firing module includes an electrical detonator connected to a detonating cord, the detonating cord being extended to be adjacent the frangible element, and wherein activation of the electrical detonator initiates a detonation wave in the detonating cord, the detonation wave shattering the frangible element.

4. The apparatus of claim 1, wherein the actuating assembly further includes a chamber filled with well fluid under pressure of the well and a chamber filled with air, the release piston being movable by differential pressure between the well fluid chamber and the air chamber.

5. The apparatus of claim 1, wherein the detonating assembly includes a percussion detonator, and wherein the actuating assembly further includes a firing pin and a firing pin locking mechanism for locking the firing pin to prevent the firing pin from impacting the detonator, the release piston being adapted, in its movement, to release the firing pin locking mechanism.

6. The apparatus of claim 1, wherein the actuating assembly further includes shear pins for holding the release piston, and wherein the fluid pressure must apply a force of sufficient magnitude to break the shear pins to move the release piston.

7. The apparatus of claim 1, including a firing pin and a fluid chamber housing, the firing pin being driven by pressure generated by fluid in the fluid chamber housing, the fluid chamber housing initially filled with air, the actuating assembly further including an explosive detonated in response to electrical activation of the firing module to create an opening in the fluid chamber housing to allow well fluid under pressure to flow into the fluid chamber housing.

8. The apparatus of claim 7, wherein the fluid chamber housing is defined at least in part by a hollow tube connected at one end to be moved by the release piston, and constructed at the other end to release the firing pin.

9. The apparatus of claim 8, including seats disposed about the hollow tube, and sealably engaged between the hollow tube and an outer housing to cooperate in defining the fluid chamber with air in the vicinity of the firing pin.

10. The apparatus of claim 1, further comprising:

a connecting assembly configured for connection between the electrically-activated firing module and a coiled tubing.

11. The apparatus of claim 1, further comprising:

a connecting assembly configured for connection between the electrically-activated firing module and a wireline.

12. The apparatus of claim 1, wherein the detonating assembly includes a detonator coupled to a detonating cord, the detonating cord for connection to the perforating gun.

13. Apparatus for firing an electrically-activated perforation system having a perforating gun in a well using an electric power source, the apparatus comprising:

an electrically-activated firing module for electrical connection to the electric power source;

a detonating assembly for connection to the perforating gun; and an actuating system connected to the firing module for ballistically connecting the firing module to the detonating assembly once a minimum amount of fluid pressure is applied to the actuating system.

14. The apparatus of claim 13, wherein the actuating system includes a release piston movable by fluid pressure to ballistically connect the firing module to the detonating assembly.

15. The apparatus of claim 14, wherein the actuating system further includes a frangible element connected to hold the release piston in place, the frangible element being shattered in response to electrical activation of the firing module.

16. The apparatus of claim 14, wherein the actuating assembly further includes a chamber filled with well fluid and a chamber filled with air, the release piston being movable by differential pressure between the well fluid chamber and the air chamber.

17. The apparatus of claim 14, wherein the actuating system further includes a firing pin and a locking mechanism, the locking mechanism locking the firing pin to prevent the firing pin from activating the detonating assembly, and wherein the movement of the release piston releases the locking mechanism.

18. The apparatus of claim 13, wherein the actuating system further includes shear pins for holding the release piston, and wherein the fluid pressure must apply a force of sufficient magnitude to break the shear pins to move the release piston.

19. The apparatus of claim 13, further comprising:

a connecting assembly configured for connecting the electrically-activated firing module to a coiled tubing.

20. The apparatus of claim 13, further comprising:

a connecting assembly configured for connecting the electrically-activated firing system to a wireline.

21. The apparatus of claim 13, wherein the detonating assembly includes a detonator coupled to a detonating cord, the detonating cord for connection to the perforating gun.

22. A method of firing a perforating gun in a well, comprising:

connecting a perforating apparatus to the perforating gun, the perforating apparatus including an electrically-activated firing module, an actuating assembly coupled to the firing module, and a detonating assembly, wherein the actuating assembly includes a release piston movable by fluid pressure and a locking assembly connected to hold the release piston in position;

lowering the firing apparatus and perforating gun into the well; and electrically activating the firing module, wherein the locking assembly is configured to respond to the electrical activation by releasing the release piston, and wherein the detonating assembly is activated to fire the perforating gun in response to movement of the release piston.

23. The method of claim 22, further comprising:

holding the release piston in place with a frangible element, wherein the electrical activation of the firing module shatters the frangible element to allow the release piston to move.

24. The method of claim 22, wherein the actuating assembly further includes a chamber filled with well fluid and a chamber filled with air, the release piston being movable by differential pressure between the well fluid chamber and the air chamber.

25. A method of firing an electrically-activated perforation system having a perforating gun in a well using an electric power source, the method comprising:

electrically connecting an electrically-activated firing module to the electric power source;

lowering the perforation system downhole in the well; and ballistically connecting the firing module to a detonating cord once a minimum amount of fluid pressure is present.

26. The method of claim 25, wherein the actuating system includes a release piston, the method further comprising:

applying fluid pressure to move the release piston, the release piston being movable if the minimum amount of fluid pressure is present.

27. The method of claim 26, further comprising:

holding the release piston in place with a frangible element; and activating the firing module to shatter the frangible element to allow the release piston to move.

28. Apparatus for firing a perforating gun in a well, comprising:

an electrically-activated firing system;

an actuating assembly coupled to the firing system, the actuating assembly including:

a release piston movable by fluid pressure, a frangible element connected to hold the release piston in place, the frangible element being shattered in response to electrical activation of the firing system, a firing pin, and a locking mechanism for locking the firing pin to prevent movement of the firing pin, wherein the release piston is connected to release the locking mechanism if a minimum amount of fluid pressure is applied to the release piston after electrical activation of the firing system; and a detonating assembly for connection to the perforating gun and being activable by the firing pin, the detonating assembly being activated when the firing pin is released by the locking mechanism to impact the detonating assembly.

29. The apparatus of claim 28, wherein the actuating assembly further includes:

an explosive; and a fluid chamber housing connected to the firing pin, the firing pin being driven by pressure generated by fluid in the fluid chamber housing, the fluid chamber housing initially filled with air, the explosive being detonated in response to electrical activation of the firing module to create an opening in the fluid chamber housing to allow well fluid to flow into the fluid chamber housing.

30. A detonating apparatus for activating an electrically-activated device in a well using an electric power source, the apparatus comprising:

an electrically-activated activation module for electrical connection to the electric power source;

a detonating assembly for connection to the device; and an actuating system connected to the activation module for ballistically connecting the activation module to the detonating assembly once a minimum amount of fluid pressure is applied to the actuating system.

31. The apparatus of claim 30, wherein the actuating system includes a release piston movable by fluid pressure to ballistically connect the activation module to the detonating assembly.

32. The apparatus of claim 31, wherein the actuating system further includes a frangible element connected to hold the release piston in place, the frangible element being shattered in response to electrical activation of the activation module.

33. A method of electrically activating a device in a well using an electric power source, the method comprising:

electrically connecting an electrically-activated activation module to the electric power source;

lowering the device downhole in the well; and ballistically connecting the activation module to a detonating cord once a minimum amount of fluid pressure is present.

34. The method of claim 33, wherein the actuating system includes a release piston, the method further comprising:

applying fluid pressure to move the release piston, the release piston being movable if the minimum amount of fluid pressure is present.

35. The method of claim 34, further comprising:

holding the release piston in place with a frangible element; and activating the activation module to shatter the frangible element to allow the release piston to move.

* * * * *